US006000272A

United States Patent [19]

Hinson

[11] Patent Number: 6,000,272

[45] Date of Patent: Dec. 14, 1999

[54] TILT APPARATUS FOR VEHICLE REPAIR RACK

[76] Inventor: Virgil H. Hinson, 373 Choetaw Sq., Brunswick, Ga. 31525

[21] Appl. No.: 09/152,720

[22] Filed: Sep. 14, 1998

[51] Int. Cl.[6] ..... B21J 13/08

[52] U.S. Cl. ..... 72/457; 72/705; 254/30

[58] Field of Search ..... 72/705, 457; 187/203, 187/207, 210, 215; 254/30

[56] References Cited

U.S. PATENT DOCUMENTS

| | | | |
|---|---|---|---|
| 4,592,225 | 6/1986 | Eck | 72/705 |
| 4,854,151 | 8/1989 | Belgarde | 72/705 |
| 4,916,933 | 4/1990 | Celette | 72/705 |
| 5,027,639 | 7/1991 | Hinson | 72/705 |
| 5,784,921 | 7/1998 | Venalainen | 72/705 |

*Primary Examiner*—Ed Tolan

*Attorney, Agent, or Firm*—James B. Middleton; Walter A. Rodgers

[57] ABSTRACT

A vehicle repair rack having a platform for receiving vehicles for straightening is tilted as it is raised from the floor for easier loading of low vehicles, without the vehicle's bottoming out. The repair rack uses a parallel linkage to raise the platform. The platform is one link of the parallel linkage; and, the link that is parallel to the platform is allowed to elongate as the platform is raised, thereby causing the platform to move into non-parallelism with respect to the elongated link, so the platform is tilted. The parallel linkage includes legs as the other two links, and a connecting rod between the two legs is the elongating link. One end of the connecting rod has a slot that allows the connecting rod to move axially to a limited extent for the elongation.

1 Claim, 2 Drawing Sheets

TILT APPARATUS FOR VEHICLE REPAIR RACK

BACKGROUND OF THE INVENTION

1. Field of the Invention

This invention relates generally to vehicle repair apparatus, and is more particularly concerned with means for tilting a repair rack during the raising of the rack above the floor.

2. Discussion of the Prior Art

Apparatus for repairing automotive vehicles following a collision typically includes a platform onto which the vehicle is loaded. The platform is subsequently raised above the floor level to have the vehicle at a convenient height for the work of straightening the vehicle. In raising the platform, the most common means is to provide a parallel linkage so that the platform is raised uniformly, and is level at all times.

The parallel linkage works well under most conditions, and such apparatus has been commercially successful: see for example U.S. Pat. No. 5,027,639. Using the parallel linkage, the platform is level on the floor, and the platform remains level as the platform is raised to any desired height. Other prior art apparatus utilizes separate fluid operated cylinders on each of the four legs supporting the platform; and, while such an arrangement works, it is more expensive than the use of one cylinder with mechanical linkages as in the cited patent.

In recent times, a number of automobiles are being made very low, so the undercarriage is close to the ground. It has been found that, in loading such a vehicle onto the prior art racks, the cars tend to "bottom out" as they move onto the platform. The lowest such a platform will go is flat on the floor, so there is no means for preventing the bottoming out, and consequent potential damage to the vehicle.

SUMMARY OF THE INVENTION

The present invention provides, in combination with a generally conventional automotive repair rack, means for tilting the platform as the platform rises above the floor. The platform lies on the floor parallel to the floor as is usual; then, as the platform begins to rise, one end of the platform rises before the other, causing the platform to tilt. In this tilted state, while one end of the platform is substantially on the floor, a vehicle can be loaded onto the platform. Due to the tilt of the platform, very low vehicles will not bottom out as they move onto the platform. Once the vehicle is fully on the platform, the platform can be raised as desired.

In the preferred embodiment of the invention, a rack such as that disclosed in U.S. Pat. No. 5,027,639 is modified by allowing one link of the parallel linkage to elongate as the platform rises. When one link becomes longer, its parallel link will move out of parallelism; therefore, by making the platform the link that moves out of parallelism, the platform will tilt.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Figure 1:
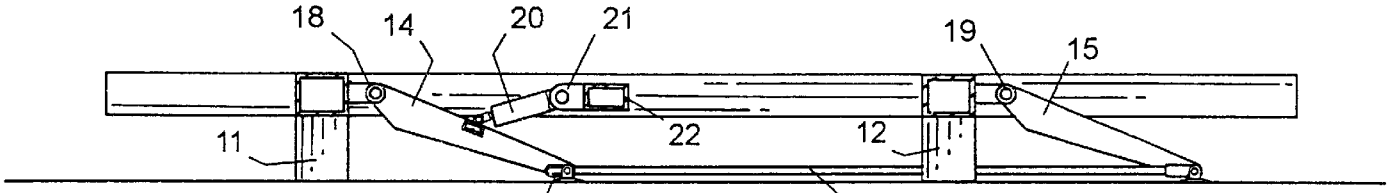
FIG. 1 is a longitudinal cross-sectional view through a repair rack embodying the present invention.

Referring now more particularly to the drawings, and to that embodiment of the invention here presented by way of illustration, it will be seen that there is a platform 10 supported on a plurality of feet 11 and 12. It will of course be understood that FIG. 1 is a cross-sectional view, and not all the feet are shown. The rack is shown in more detail in U.S. Pat. No. 5,027,639 (hereinafter referred to as the '639 patent), and the full disclosure of that patent is incorporated herein by this reference.

Adjacent to each of the feet 11 and 12 there is a leg, such as the legs 14 and 15; and, pivotally connecting the lower ends of the legs 14 and 15 is a connecting rod 16. The upper ends of the legs 14 and 15 are pivotally fixed to the platform 10 at 18 and 19 respectively. As a result of this structure, it will be understood that a parallel linkage has been formed, with the legs 14 and 15 acting as the short links that are parallel to each other, and the platform 10 and connecting rod 16 acting as the long links that are parallel to each other. In accordance with well known principles, if the angle of one link with respect to another changes, all angles will change by a substantially equal amount.

The means to raise the platform 10 is here shown as a fluid operated cylinder 20. The cylinder 20 is pivotally fixed to the platform 10 by an ear 21 which is fixed to a cross member 22. The piston rod 24 is pivotally fixed to the leg 14 so that, as the piston rod is projected, the leg 14 will be moved towards a right angle with respect to the platform 10, thereby raising the platform. If all the links in the parallelogram are of fixed length, and all links are pivoted, then the leg 15 must move the same amount as the leg 14, so the platform 10 will rise uniformly, and level. Such structure is disclosed in the '639 patent.

It should be pointed out that, in reality, there is a cross member extending between two or more legs 14 for supporting one end of a platform 10, and the cylinder 20 is fixed to that cross member. For purposes of discussion, the connection may be said to be to the leg 14, but the result is the same, as will be understood by those skilled in the art.

Figure 3:
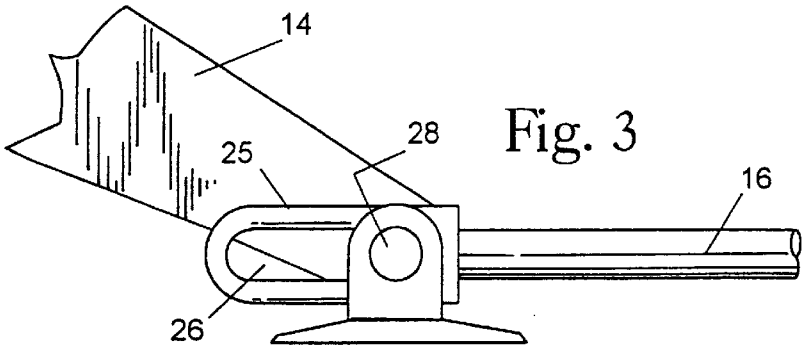
FIG. 3 is an enlarged fragmentary view showing means for elongating one link.
Figure 4:
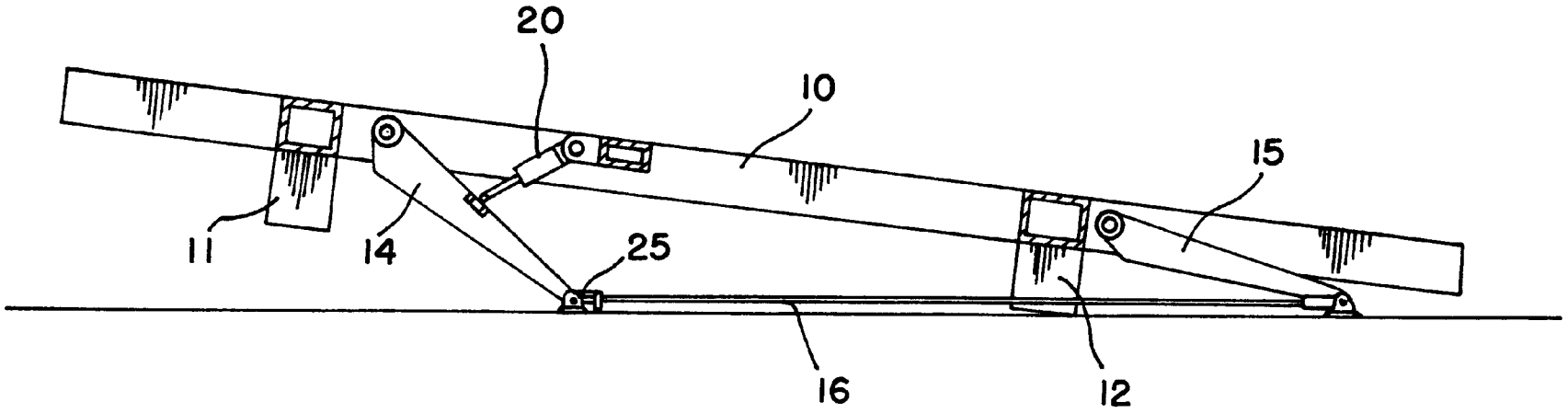
FIG. 4 is similar to FIG. 1 but shows the rack in a tilted condition.

In the present invention, the connecting rod 16 is pivotally connected at both ends to the legs 14 and 15; however, one of the connections is allowed to slip. The construction of the connection is shown in FIG. 3 of the drawings where it will be seen that the connecting rod 16 terminates in a fitting 25 that defines an elongated slot 26. FIG. 3 shows the parts in the same position as in FIG. 1. A pin 28 is fixed to the leg 14 and passes through the slot 26, so the connecting rod 16 can slip axially of the rod to the extent of the slot 26. The opposite end of the connecting rod is constructed in a similar manner, but there is no slot, so the rod 16 is pivotally fixed to the leg 15.

With the above described construction in mind, the operation of the apparatus of the present invention should be understandable. With the piston rod of the cylinder 20 fully retracted, the leg 14 will be in its most counterclockwise position, with the platform closest to the floor. This is the position in which the prior art apparatus will load vehicles onto the platform. With the present invention, however, the piston rod 24 will be slightly projected, causing the leg 14 to rotate clockwise as shown in the drawings, forming a larger angle with respect to the platform 10. This causes the platform 10 to rise.

Figure 2:
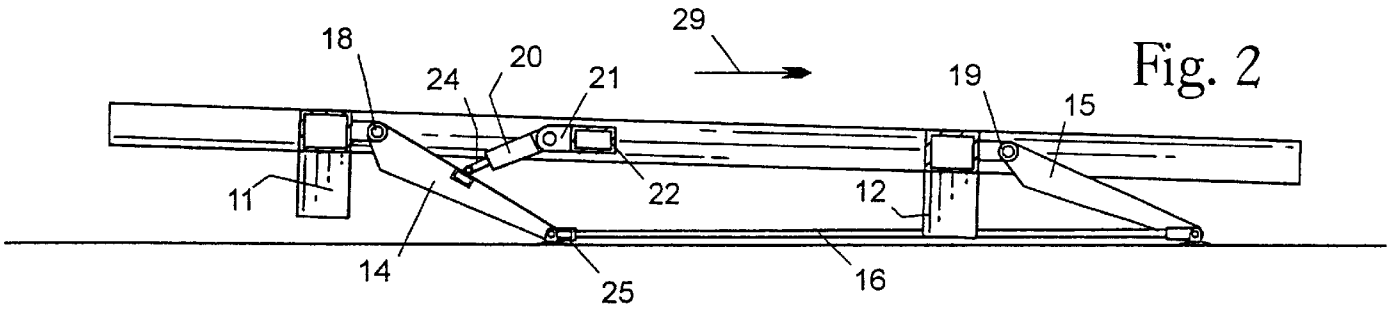
FIG. 2 is similar to FIG. 1 but showing the rack slightly raised and tilted.

As the leg 14 moves, it will be understood that there is a component of force in the direction of the arrow 29. This force will be exerted through the platform 10 and the leg 15 to the connecting rod 16. The connecting rod 16 will therefore move to the right as shown in the drawings because the slot 26 allows such movement. So long as the connecting rod 16 moves axially, the angle of the leg 15 with respect to the platform 10 will not change. The result is that the end of the platform supported by the leg 14 rises while the end supported by the leg 15 remains in its lowest position. This creates a tilted platform as shown in FIG. 2 of the drawings.

When the pin 28 reaches the opposite end of the slot 26, there can be no further movement, and the linkage is quite stable, so the height of the platform 10 can be adjusted as desired. When the platform 10 is lowered, the tilt will remain until the platform approaches its lowest level. Since the platform will ultimately rest on the feet 11 and 12 on the floor, the connecting rod and the platform 10 will once again be parallel, and the pin 28 will be in the position shown in FIG. 3 of the drawings.

It will of course be understood by those skilled in the art that the particular embodiment of the invention here presented is by way of illustration only and is meant to be in no way restrictive; therefore, numerous changes and modification may be made, and the full use of equivalents resorted to, without departing from the spirit or scope of the invention as outlined in the appended claims.

What is claimed as invention is:

1. A vehicle repair rack comprising a platform for receiving a vehicle to be repaired, means for raising said platform above floor level, said means for raising said platform including a parallel linkage, said parallel linkage including a plurality of legs pivotally connected to said platform, two legs of said plurality of legs being spaced apart and parallel to form two links of said parallel linkage, a connecting rod pivotally connected to said two legs, said connecting rod being parallel to said platform when said platform is at floor level, said connecting rod including a fitting for connection to one of said two legs, said fitting defining an elongated slot therein, and a pin passing through said slot and fixed to said one leg so that said connecting rod moves axially with respect to said one leg.

* * * * *